US006173059B1

(12) United States Patent
Huang et al.

(10) Patent No.: US 6,173,059 B1
(45) Date of Patent: Jan. 9, 2001

(54) TELECONFERENCING SYSTEM WITH VISUAL FEEDBACK

(75) Inventors: Jixiong Huang, Brighton; Richard S. Grinnell, Brookline, both of MA (US)

(73) Assignee: Gentner Communications Corporation, Salt Lake City, UT (US)

( * ) Notice: Under 35 U.S.C. 154(b), the term of this patent shall be extended for 0 days.

(21) Appl. No.: 09/066,163

(22) Filed: Apr. 24, 1998

(51) Int. Cl.[7] ..... H04R 1/40

(52) U.S. Cl. ..... 381/92; 379/202

(58) Field of Search ..... 381/92; 367/118, 367/119, 121, 122, 124, 126; 379/202

(56) References Cited

U.S. PATENT DOCUMENTS

| | | | |
|---|---|---|---|
| 3,755,625 | 8/1973 | Maston | 179/1 |
| 3,906,431 | 9/1975 | Clearwaters et al. | 340/6 |
| 4,070,547 | 1/1978 | Dellar | 179/1 |
| 4,072,821 | 2/1978 | Bauer | 179/1 |
| 4,096,353 | 6/1978 | Bauer | 179/1 |
| 4,131,760 | 12/1978 | Christensen et al. | 179/1 |
| 4,198,705 | 4/1980 | Massa | 367/126 |
| 4,237,339 | 12/1980 | Bunting et al. | 179/1 |
| 4,254,417 | 3/1981 | Speiser | 343/100 |
| 4,305,141 | 12/1981 | Massa | 367/105 |
| 4,308,425 | 12/1981 | Momose et al. | 179/1 |
| 4,334,740 | 6/1982 | Wray | 352/11 |
| 4,399,327 | 8/1983 | Yamamoto et al. | 179/1 |
| 4,410,770 | 10/1983 | Hagey | 179/121 |
| 4,414,433 | 11/1983 | Horie et al. | 179/70 |
| 4,436,966 | 3/1984 | Botros | 179/121 |
| 4,449,238 | 5/1984 | Lee et al. | 381/110 |
| 4,466,117 | 8/1984 | Gorike | 381/26 |
| 4,485,484 | 11/1984 | Flanagan | 381/92 |
| 4,489,442 | 12/1984 | Anderson et al. | 381/81 |
| 4,521,908 | 6/1985 | Miyaji et al. | 381/92 |
| 4,559,642 | 12/1985 | Miyaji et al. | 381/92 |
| 4,653,102 | 3/1987 | Hansen | 381/92 |
| 4,658,425 | 4/1987 | Julstrom | 381/81 |
| 4,669,108 | 5/1987 | Deinzer | 379/61 |
| 4,696,043 | 9/1987 | Iwahara et al. | 381/92 |
| 4,703,506 | 10/1987 | Sakamoto et al. | 381/92 |
| 4,712,231 | 12/1987 | Julstrom | 379/202 |

(List continued on next page.)

*Primary Examiner*—David R. Hudspeth
*Assistant Examiner*—Harold Zintel
(74) *Attorney, Agent, or Firm*—Kudirka & Jobse, LLP

(57) ABSTRACT

A telephone system includes two or more cardioid microphones held together and directed outwardly from a central point. Mixing circuitry and control circuitry combines and analyzes signals from the microphones and selects the signal from one of the microphones or from one of one or more predetermined combinations of microphone signals in order to track a speaker as the speaker moves about a room or as various speakers situated about the room speak then fall silent. Visual indicators, in the form of light emitting diodes (LEDs) are evenly spaced around the perimeter of a circle concentric with the microphone array. Mixing circuitry produces ten combination signals, A+B, A+C, B+C, A+B+C, A–B, B–C, A–C, A–0.5(B+C), B–0.5(A+C), and C–0.5(B+A), with the "listening beam" formed by combinations, such as A–0.5(B+C), that involve the subtraction of signals, generally being more narrowly directed than beams formed by combinations, such as A+B, that involve only the addition of signals. An omnidirectional combination A+B+C is employed when active speakers are widely scattered throughout the room. Weighting factors are employed in a known manner to provide unity gain output. Control circuitry selects the signal from the microphone or from one of the predetermined microphone combinations, based generally on the energy level of the signal, and employs the selected signal as the output signal. The control circuitry also operates to limit dithering between microphones and, by analyzing the beam selection pattern, may switch to a broader coverage pattern, rather than switching between two narrower beams that each covers one of the speakers.

19 Claims, 7 Drawing Sheets

U.S. PATENT DOCUMENTS

| | | | |
|---|---|---|---|
| 4,712,244 | 12/1987 | Zwicker et al. | 381/68.1 |
| 4,741,038 | 4/1988 | Elko et al. | 381/92 |
| 4,752,961 | 6/1988 | Kahn | 381/92 |
| 4,815,132 | 3/1989 | Minami | 381/1 |
| 4,860,366 | 8/1989 | Fukushi et al. | 381/106 |
| 4,903,247 | 2/1990 | Van Gerwen et al. | 367/135 |
| 5,058,170 | 10/1991 | Kanamori et al. | 381/92 |
| 5,121,426 | 6/1992 | Baumhauer, Jr. et al. | 379/388 |
| 5,214,709 | 5/1993 | Ribic | 381/68.1 |
| 5,226,087 | 7/1993 | Ono et al. | 381/92 |
| 5,243,660 | 9/1993 | Zagorski | 381/92 |
| 5,463,694 | 10/1995 | Bradley et al. | 381/92 |
| 5,483,599 | 1/1996 | Zagorski | 381/68.5 |
| 5,500,903 | 3/1996 | Gulli | 381/92 |
| 5,506,908 | 4/1996 | Baumhauer, Jr. et al. | 381/92 |
| 5,561,737 * | 10/1996 | Bowen | 704/275 |
| 5,664,021 | 9/1997 | Chu et al. | 381/92 |
| 5,703,957 | 12/1997 | McAteer | 381/92 |
| 5,737,431 | 4/1998 | Brandstein et al. | 381/92 |

* cited by examiner

TELECONFERENCING SYSTEM WITH VISUAL FEEDBACK

FIELD OF THE INVENTION

The invention relates generally to the reception, mixing, analysis, and selection of acoustic signals in a noisy environment, particularly in the context of speakerphone and telephone conferencing systems.

BACKGROUND OF THE INVENTION

Although telephone technology has been with us for some time and, through a steady flow of innovations over the past century, has matured into a relatively effective, reliable means of communication, the technology is not flawless. Great strides have been made in signal processing and transmission of telephone signals and in digital networks and data transmission. Nevertheless, the basic telephone remains largely unchanged, with a user employing a handset that includes a microphone located near and directed towards the user's mouth and an acoustic transducer positioned near and directed towards the user's ear. This arrangement can be rather awkward and inconvenient. In spite of the inconvenience associated with holding a handset, this arrangement has survived for many years: for good reason. The now familiar, and inconvenient, telephone handset provides a means of limiting the inclusion of unwanted acoustic signals that might otherwise be directed toward a receiver at the "other end" of the telephone line. With the telephone's microphone held close to and directed toward a speaker's mouth other acoustic signals in the speaker's immediate vicinity are overpowered by the desired speech signal.

However, there are many situations in which the use of a telephone handset is simply impractical, whether because the telephone user's hands must be free for activities other than holding a handset or because several speakers have gathered for a telephone conference. "Hands free" telephone sets of various designs, including various speaker-phones and telephone conferencing systems, have been developed for just such applications. Unfortunately, speaker-phones and telephone conferencing systems in general tend to exhibit annoying artifacts of their acoustic environments. In addition to the desired acoustic signal from a speaker, echos, reverberations, and background noise are often combined in a telephone transmission signal.

In audio telephony systems it is important to accurately reproduce the desired sound in the local environment, i.e., the space in the immediate vicinity of a speaker, while minimizing background noise and reverberance. This selective reproduction of sound from the local environment and exclusion of sound outside the local environment is the function at which a handset is particularly adept. The handset's particular facility for this function is the primary reason that, in spite of their inconvenience, handsets nevertheless remain in widespread use. For teleconferencing applications handsets are impractical, yet it is particularly advantageous to capture the desired acoustic signals with a minimum of background noise and reverberation in order to provide clear and understandable audio at the receiving end of telephone line.

A number of technologies have been developed to acquire sound in the local environment. Some teleconferencing systems employ directional microphones, i.e., microphones having a fixed directional pickup pattern most responsive to sounds along the microphone's direct axis, in an attempt to reproduce the selectivity of a telephone handset. If speakers are arranged within a room at predetermined locations which locations are advantageously chosen based upon the responsivity of microphones situated about the room, acceptable speech reproduction may be achieved. The directional selectivity of the directional microphones accents speech that is directed toward a microphone and suppresses other acoustic signals such as echo, reverberations, and other off-axis room sounds. Of course, if these undesirable acoustic signals are directed on-axis toward one of the microphones, they too will be selected for reproduction. In order to accommodate various speakers within a room, such systems typically gate signals from the corresponding microphones on or off, depending upon who happens to be actively speaking. It is generally assumed that the microphone receiving the loudest acoustic signal is the microphone corresponding to the active speaker. However, this assumption can lead to undesirable results, such as acoustic interference, which is discussed in greater detail below.

Moreover, it is unnatural and uncomfortable to force a speaker to constantly "speak into the microphone" in order to be heard. More recently, attempts have been made to accommodate speakers as the change positions in their seats, as they move about a conference room, and as various participants in a conference become active speakers. One approach to accommodating a multiplicity of active speakers within a conference room involves combining signals from two directional microphones to develop additional sensitivity patterns, or "virtual microphones", associated with the combined microphone signals. To track an active speaker as the speaker moves around the conference room, the signal from the directional microphone or virtual directional microphone having the greatest response is chosen as the system's output signal. In this manner, the system acts, to some extent, as directional microphone that is rotated around a room to follow an active speaker.

However, such systems only provide a limited number of directions of peak sensitivity and the beamwidth is typically identical for all combinations. Some systems employ microphone arrangements which produce only dipole reception patterns. Although useful in some contexts, dipole patterns tend to pick up noise and unwanted reverberations. For example, if two speakers are seated across a table from one another, a dipole reception pattern could be employed to receive speech from either speaker, without switching back and forth between the speakers. This provides a significant advantage, in that the switching of microphones can sometimes be distracting, either because the speech signal changes too abruptly or because the background noise level shifts too dramatically. On the other hand, if a speaker has no counterpart directly across the table, a dipole pattern will, unfortunately, pick up the background noise across the table from the speaker, as well as that in the immediate vicinity of the speaker. Additionally, with their relatively narrow reception patterns, or beams, dipole arrangements are not particularly suite for wide area reception, as may be useful when two speakers, although seated on the same side of a conference table, are separated by some distance. Consequently, systems which employ dipole arrangements tend to switch between microphones with annoying frequency in such a situation. This is also true when speakers are widely scattered about the microphone array.

One particularly annoying form of acoustic interference that crops up in the context of a telephone conference, particularly in those systems which select signals from among a plurality of microphones, is a result of the fact that the energy of an acoustic signal declines rapidly with distance. A relatively small acoustic signal originating close to a microphone may provide a much more energetic signal to a microphone than a large signal that originates far away from a microphone. For example, rustling papers or drumming fingers on a conference table could easily dominate the signal from an active speaker pacing back and forth at some distance from the conference table. As a result, the receiving party may hear the drumbeat of "Sing, Sing, Sing" pounded out by fingertips on the conference table, rather than the considered opinion of a chief executive officer in the throes of a takeover battle. Oftentimes people engage in such otherwise innocuous activities without even knowing they are doing so. Without being told by an irritated conferee that they are disrupting the meeting, there is no way for them to know that they have done so, and they continue to "drown out" the desired speech. At the same time, the active speaker has no way of knowing that their speech has been suppressed by this noise unless a party on the receiving end of the conversation asks them to repeat a statement.

SUMMARY OF THE INVENTION

A telephone system in accordance with the principles of the present invention includes two or more cardioid microphones held together and directed outwardly from a central point. Mixing circuitry and control circuitry combines and analyzes signals from the microphones and selects the signal from one of the microphones or from one of one or more predetermined combinations of microphone signals in order to track a speaker as the speaker moves about a room or as various speakers situated about the room speak then fall silent.

In an illustrative embodiment, an array of three cardioid directional microphones, A, B, and C, are held together directed outward from a central point and separated by 120 degrees. Visual indicators, in the form of light emitting diodes (LEDs) are evenly spaced around the perimeter of a circle concentric with the microphone array. Mixing circuitry produces ten combination signals, A+B, A+C, B+C, A+B+C, A−B, B−C, A−C, A−0.5(B+C), B−0.5(A+C), and C−0.5(B+A), with the "listening beam" formed by combinations, such as A−0.5(B+C), that involve the subtraction of signals, generally being more narrowly directed than beams formed by combinations, such as A+B, that involve only the addition of signals. An omnidirectional combination A+B+C is employed when active speakers are widely scattered throughout the room. Weighting factors are employed in a known manner to provide unity gain output. That is, the combination signals are weighted so that they produce a response that is normalized to that of a single microphone, with the maximum output signal from a combination equal to the maximum output signal from a single microphone.

Control circuitry selects the signal from the microphone or from one of these predetermined microphone combinations, based generally on the energy level of the signal, and employs the selected signal as the output signal. The control circuitry also operates to limit dithering between microphones and, by analyzing the beam selection pattern may switch to the omnidirectional reception pattern afforded by the A+B+C combination. Similarly, the control system analyzes the beam selection pattern to select a broader beam that encompasses two active speakers, rather than switching between two narrower beams that each covers one of the speakers. Through the addition and subtraction of the basic cardioid reception patterns, the control circuitry may be employed to form a wide variety of combination reception patterns. In the illustrative embodiment, the output microphone signal is chosen from one of a plurality of predetermined patterns though. That is, although a plurality of combinations are employed, reception patterns typically are not eliminated, although patterns may be added, in the process of selecting and adjusting reception patterns.

The control circuitry also operates the visual feedback indicator, i.e., a concentric ring of LEDs in the illustrative embodiment, to indicate the direction and width of the listening beam, thereby providing visual feedback to users of the system and allowing speakers to know when the microphone system is directed at them.

BRIEF DESCRIPTION OF THE DRAWINGS

The above and further advantages of the invention may be better understood by referring to the following description in conjunction with the accompanying drawings in which.

DETAILED DESCRIPTION

A telephone system in accordance with the principles of the present invention includes two or more cardioid microphones held together and directed outwardly from a central point. Mixing circuitry and control circuitry combines and analyzes signals from the microphones and selects the signal from one of the microphones or from one of one or more predetermined combinations of microphones in order to track a speaker as the speaker moves about a room or as various speakers situated about the room talk then fall silent. The system may include, for example, an array of three cardioid directional microphones, A, B, and C, held together, directed outwardly from a central point, and separated by 120 degrees. Directional indicators, in the form of light emitting diodes (LEDs) are evenly spaced around the perimeter of a circle concentric with the microphone array each microphone generates an output signal designated as A, B, C, respecitvely. Mixing circuitry produces combination signals, such as A+B, A+C, B+C, A+B+C, A−B, B−C, A−C, A−0.5(B+C), B−0.5(A+C), and C−.05(A+B), with the "listening beam" formed by higher order combinations that include subtraction of signals, such as the A−0.5(B+C) combination, being more narrowly directed than that do not involve the subtraction of signals. Control circuitry selects the signal from the microphone or from one of the predetermined microphone combinations, based generally on the energy level of the signal, and employs the selected signal as the output signal. Additionally, the control circuitry lights selected LEDs to indicate the direction and width of the listening beam. This automatic visual feedback mechanism thereby provides a speaker with a near-end indication of whether he is being heard and also provides others within the room an indication that they may be interrupting the conversation.

Figure 1:
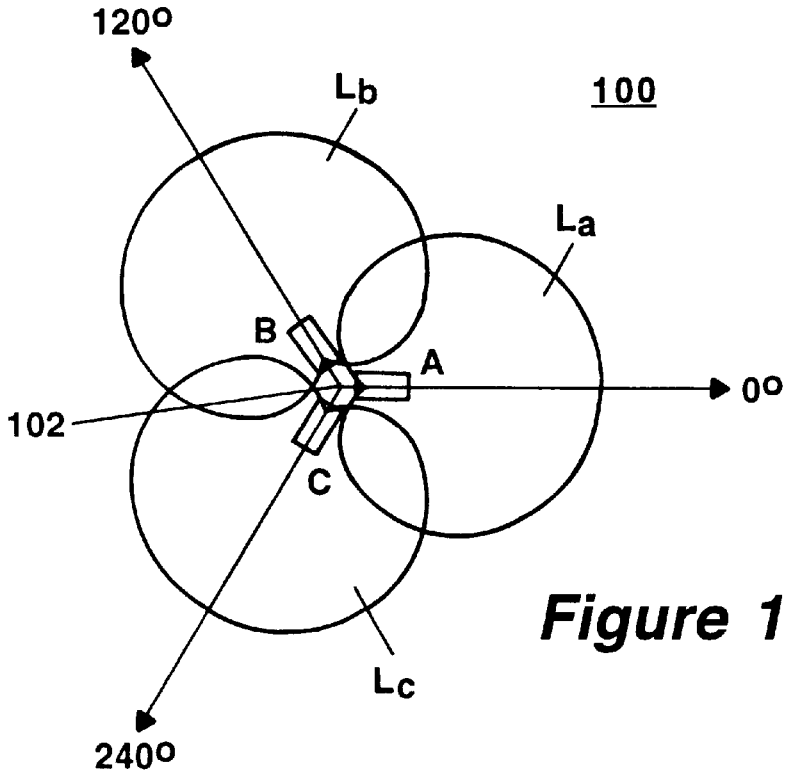
FIG. 1 is a top plan view of the possible pickup response for a 3-microphone system.

Referring to the illustrative embodiment of FIG. 1, a microphone system 100 assembled in accordance with the principles of the invention includes three cardioid microphones, A, B, and C, mounted 120 degrees apart, as close to each other and a central origin as possible. Each of the microphones has associated with it a cardioid response lobe, La, Lb, and Lc, respectively. Microphones having cardioid response lobes are known. Various directional microphone response patterns are discussed in U.S. Pat. No. 5,121,426, to Baumhauer, Jr. et al., which is hereby incorporated by reference. The microphones, A, B, and C, are oriented outwardly from an origin 102 so that the null of each microphone's response lobe is directed at the origin. By combining the microphones' electrical response signals in various proportions, different system response lobes may be produced, as discussed in greater detail in the discussion related to FIG. 14.

As seen is FIG. 1, each cardioid microphone has a response that varies with the off-axis angle fq according to the following equation:

$$\tfrac{1}{2}+\tfrac{1}{2}\cos\phi \qquad (1)$$

The response pattern described by this equation is the pear-shaped response shown by lobes La, Lb, and Lc for the microphones A, B, and C. Response lobe La is centered about 0 degrees, Lb about 120 degrees, and Lc 240 degrees. As illustrated by equation (1), each microphone has a normalized pickup value of unity along its main axis of orientation pointing outwardly from the origin 102, and a value of zero pointing in the opposite direction, i.e., towards the origin 102.

Figure 2:
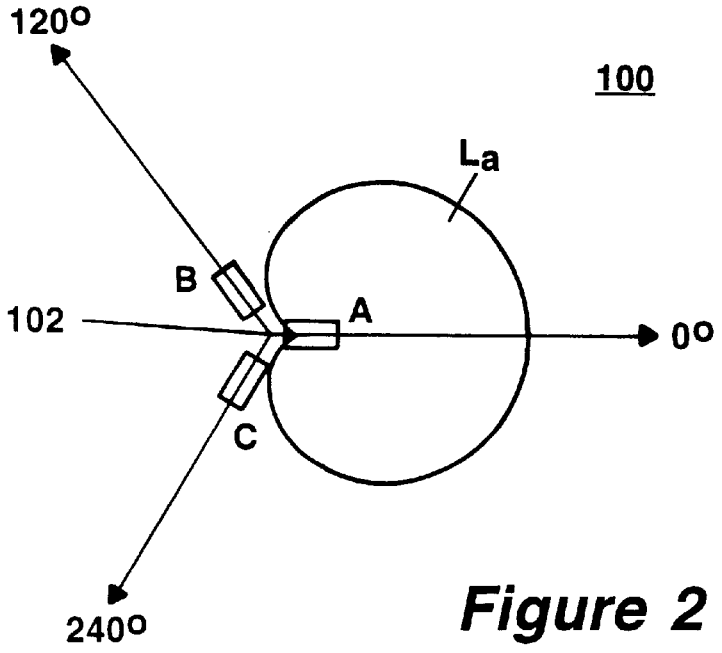
FIG. 2 is a top plan view of the pickup response provided when only one of the three microphone elements is used.

The pear-shaped response pattern of a single microphone, microphone A, is more clearly illustrated the response chart of FIG. 2, where like components to those shown in FIG. 1 are assigned like descriptors. Note that the response pattern of microphone A falls off dramatically outside the range of +−60 degrees. Consequently noise and reverberance outside that range, particularly to the rear of the microphone would have little effect on the signal produced by microphone A. Consequently, this arrangement could be used advantageously to reproduce sound from a speaker in that +−60 degree range.

Figure 3:
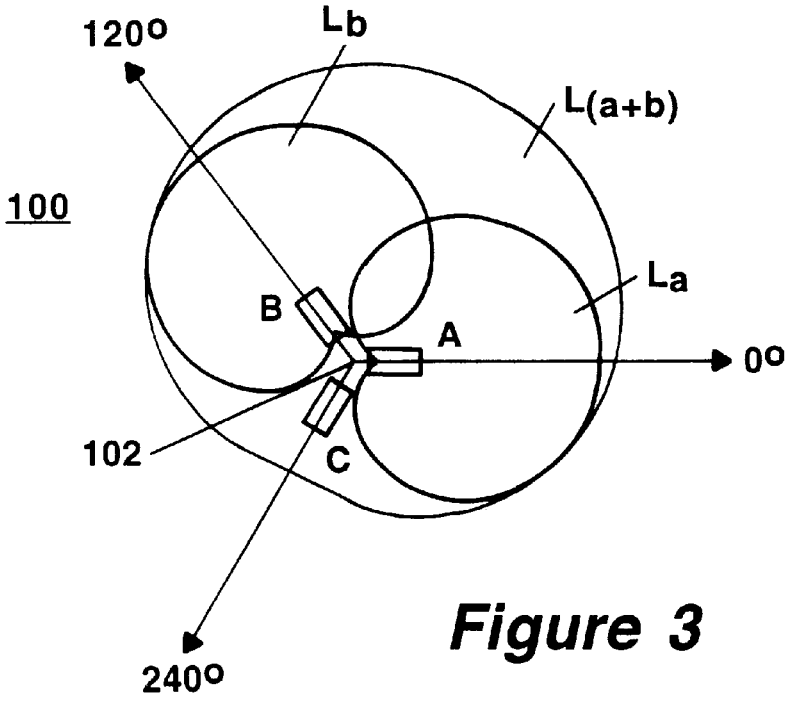
FIG. 3 is a top plan view of the pickup response provided when two of the microphone elements responses are summed together equally.

By combining signals from various microphones a number of response patterns may be obtained. The response lobe L(a+b) of FIG. 3 illustrates that a much broader response pattern may be obtained from a combination of cardioid microphones arranged as illustrated. With the inputs from microphones A and B each given equal weight then added, the response pattern L(a+b) is described by the following equation:

$$(\tfrac{1}{2}+\tfrac{1}{2}\cos\phi)+(\tfrac{1}{2}+\tfrac{1}{2}\cos(\phi-120))=1+\tfrac{1}{2}(\cos\phi+\cos(\phi-120)) \qquad (2)$$

A multiplicative gain would be applied to this signal to normalize to unity gain. That is, the response of each of the microphones combined in a simple addition would be multiplied by ⅔. This response pattern provides a wider acceptance angle than that of a single cardioid microphone, yet, unlike a combination of dipole, or polar, microphones, still significantly reduces the contribution of noise and reverberation from the "rear" of the response pattern, i.e., from the direction of the axis of microphone C. This response pattern would be particularly useful in accepting sounds within the range of −60 and 180. A broader acceptance angle such as this is particularly advantageous for a situation where two speakers are located somewhere between the axes of microphones A and B. A wider acceptance angle such as this permits a system to select a signal corresponding to this broader acceptance angle, rather than dithering between signals from microphones A and B as a system might, should dipole response patterns be all that were available to it. Such dithering is known in the art to be a distraction and an annoyance to a listener at the far end of a telephone conference. Being able to avoid dithering in this fashion provides a significant performance advantage to the inventive system.

Figure 4:
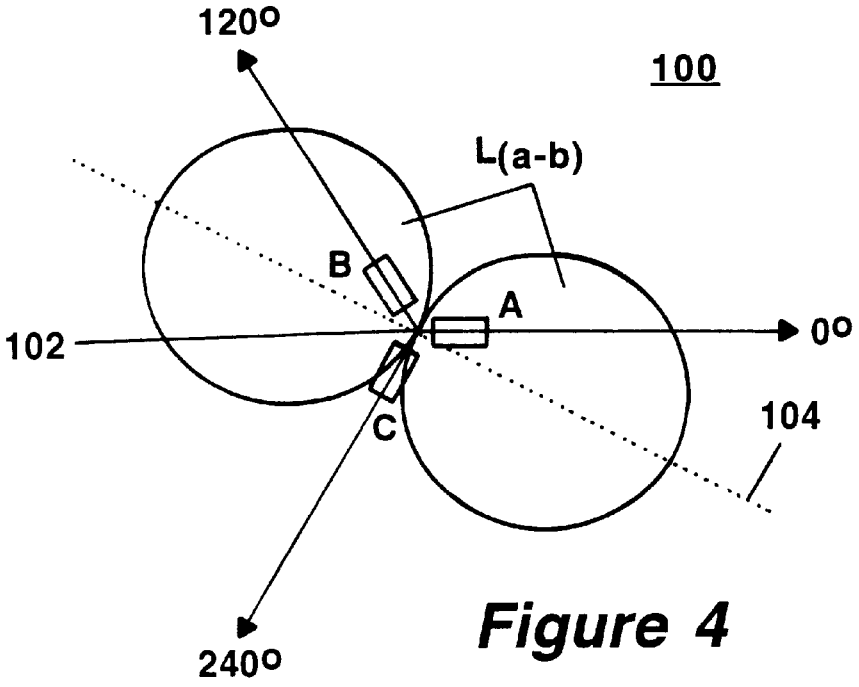
FIG. 4 is a top plan view of the possible pickup response provided when one microphone signal is subtracted from the signal of another.

That is not to say that a dipole response pattern is never desirable. As illustrated in the response pattern of FIG. 4, a dipole response pattern may be obtained, for example, by subtracting the response of microphone B from that of microphone A. In FIG. 4 a dipole response lobe L(a−b) is produced by subtracting the response of microphone B from that of microphone A according to the following equation:

$$(\tfrac{1}{2}+\tfrac{1}{2}\cos\phi)-(\tfrac{1}{2}+\tfrac{1}{2}\cos(\phi-120))=\tfrac{1}{2}\cos\phi-(\tfrac{1}{2}\cos(\phi-120))=\tfrac{1}{2}(\cos\phi-\cos(\phi-120))=0.866(\cos(\phi+30) \qquad (3)$$

A multiplicative gain would be applied to this signal to normalize to unity gain. By subtracting the signal of B from that of A, a narrower double sided pickup pattern is produced. In this example, the pattern effectively picks up sound between −75 and 15 degrees, and 105 and 195 degrees. This is especially well-suited for scenarios where audio sources are located to either side of the microphone, especially along broken line 104, and noise must be reduced from other directions.

Figure 5:
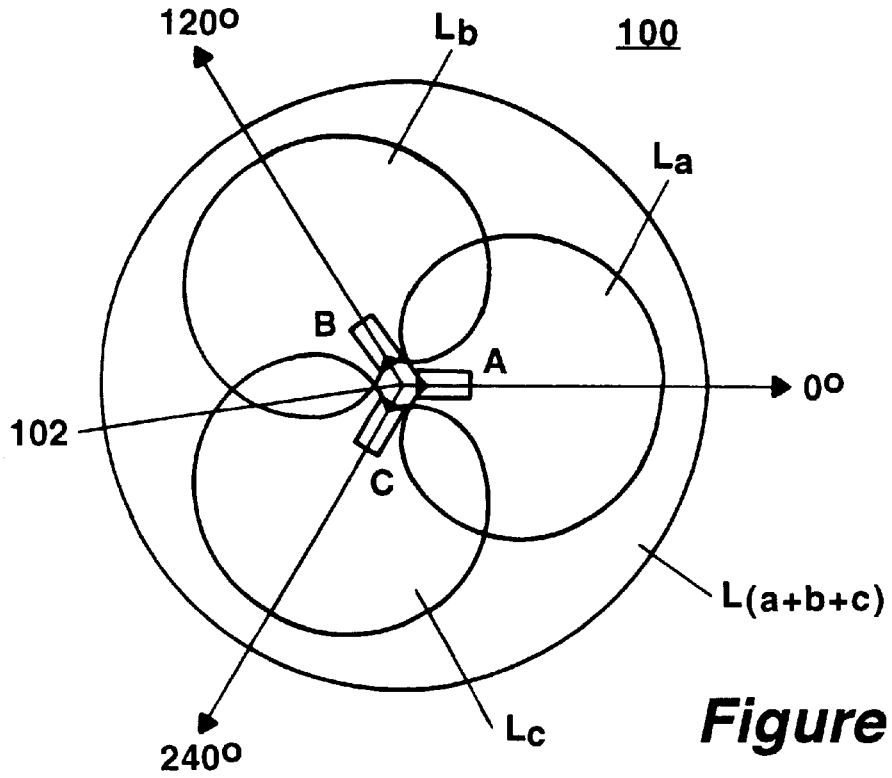
FIG. 5 is a top plan view of the possible pickup response provided when all three microphone signals are added equally.

Additional response patterns may be produced by using all three microphones. For example, FIG. 5 illustrates a response pattern that results from the addition of equally weighted signals from microphones A, B and C, which produces an omni-directional response pattern according to the following equation:

$$(\tfrac{1}{2}+\tfrac{1}{2}\cos\phi)+(\tfrac{1}{2}+\tfrac{1}{2}\cos(\phi-120))+(\tfrac{1}{2}+\tfrac{1}{2}\cos(\phi+120))=1.5+\tfrac{1}{2}(\cos\phi+\cos(\phi-120)+\cos(\phi+120))=1.5 \qquad (4)$$

A multiplicative gain would be applied to this signal to normalize to unity gain. This angle-independent response allows for sounds from sources anywhere about the microphone array to be picked up. However, no noise or reverberance reduction is achieved.

Figure 6:
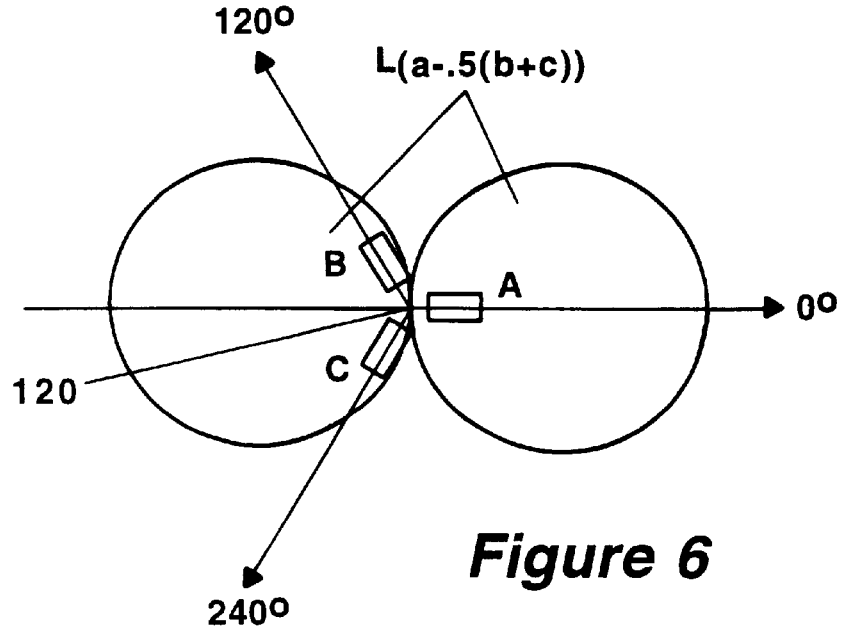
FIG. 6 is a top plan view of the possible pickup response when the signals of two microphones are added, scaled and subtracted from the signal of a third microphone.

As illustrated by the response pattern of FIG. 6, signals from all three microphones may be combined in other ways to produce, for example, the narrow dipole response pattern L(a−0.5(b+c)). The resulting narrow dipole pattern is directed toward 0 and 180 as described by the following equation:

$$(\tfrac{1}{2}+\tfrac{1}{2}\cos\phi)-0.5((\tfrac{1}{2}+\tfrac{1}{2}\cos(\phi-120))+(\tfrac{1}{2}+\tfrac{1}{2}\cos(\phi+120)))=$$

$$(\tfrac{1}{2}+\tfrac{1}{2}\cos\phi)-0.25(1+\cos\phi-120)+\cos(\phi+120))=$$

$$\tfrac{1}{2}\cos\phi-0.25(\cos(\phi-120)+\cos(\phi+120))=$$

$$0.75\cos\phi f$$

A multiplicative gain would be applied to this signal to normalize to unity gain. With this combination, the pattern effectively picks up sound between −45 and 45 degrees, and between 135 and 225 degrees. This response pattern is especially well-suited for scenarios where audio sources are located to either side of the microphone, and noise must be reduced from other directions.

In the illustrative embodiment, responses from predetermined microphones and microphone combinations, such as that provided by microphones A, B, and C, and by microphone combinations A+C, A+B, B+C, A+B+C, A−B, B−C, A−C, A−0.5(B+C), B−0.5(A+C), and C−0.5(A+B) are analyzed and one of the predetermined combinations is employed as the output signal, as described in greater detail in the discussion related to FIG. 14.

Figure 8A:
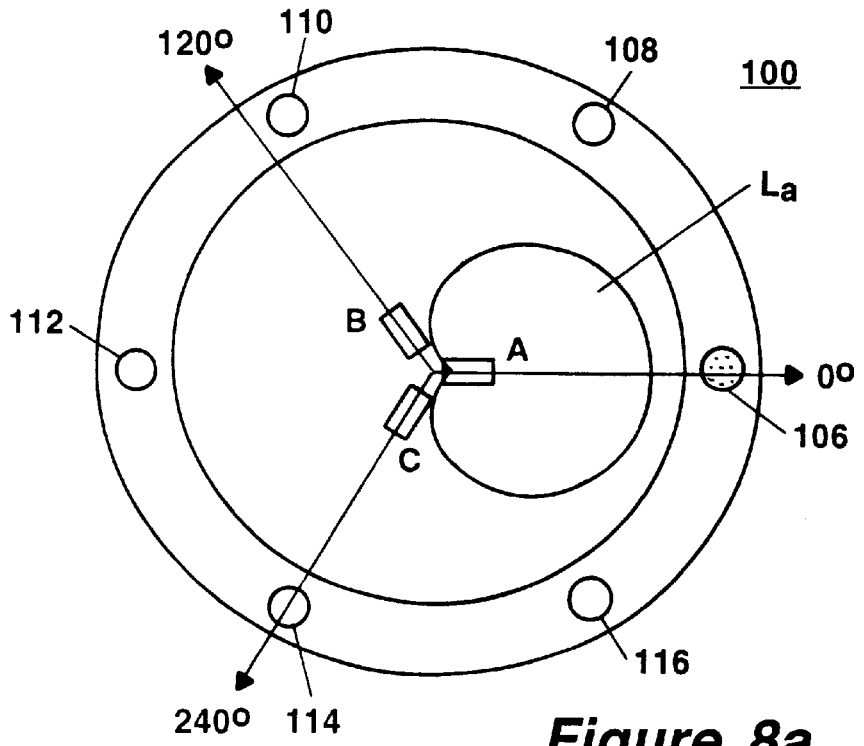
FIGS. 8*a* through 8*d* are top plan views, respectively, of the LED illumination patterns when one microphone signal is being used, the signals of two microphones are summed equally, the signals of all three microphones are added equally, and the signals of two microphones are added, scaled and subtracted from the signal of a third microphone.
Figure 8B:
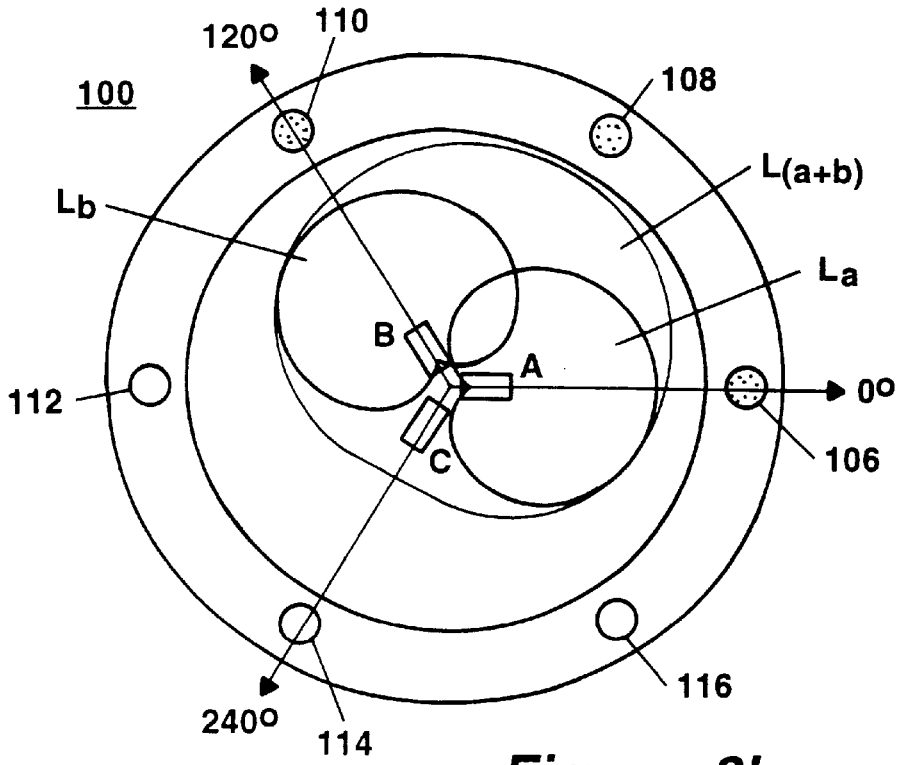
Figure 8C:
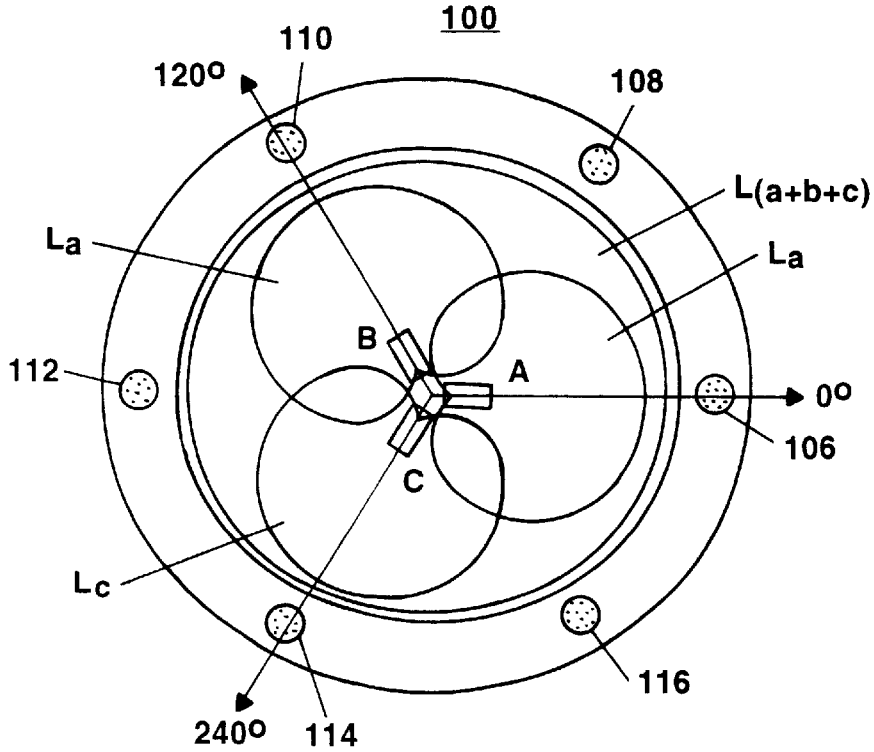
Figure 8D:
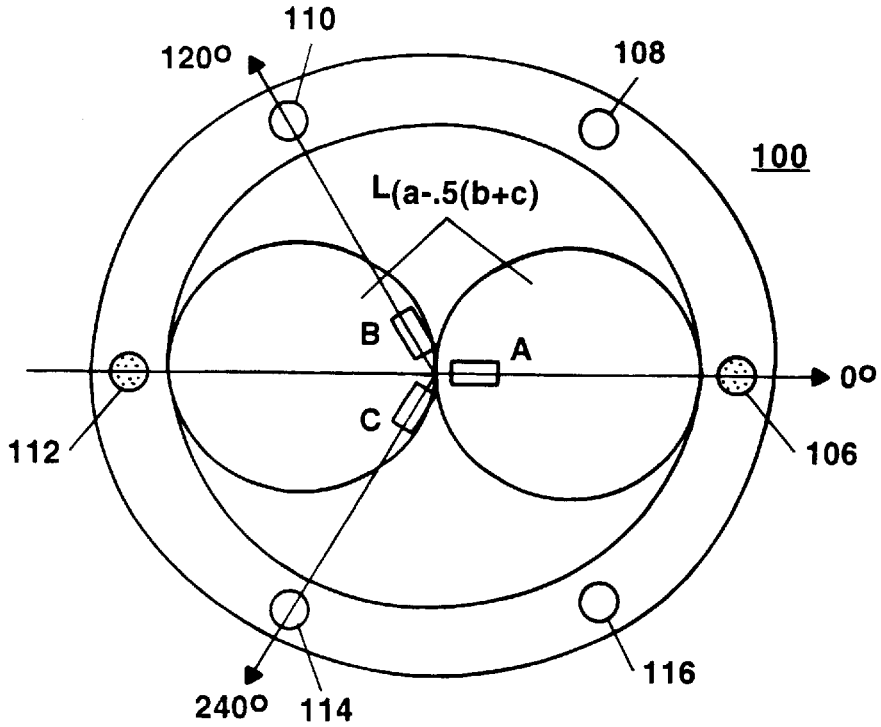

In the illustrative embodiment, the microphone system includes six LEDs arranged in a concentric circle around the perimeter of the microphone array 100, with LEDs 106, 108, 110, 112, 114, and 116 situated at 0, 60, 120, 180, 240, and 300 degrees, respectively. As the LEDs are used for visual feedback, more or fewer LEDs could be employed, and any of a number of other visual indicators, such as an LCD display that displays a pivoting virtual microphone, could be substituted for the LEDs. The number and direction of LEDs lit indicates the width and direction of the reception pattern that has been selected to produce the telephone output signal. FIGS. 8*a* through 8*b* illustrate the LED lighting patterns corresponding to various reception pattern selections. In FIG. 8*a*, for example, LED 106 is lit to indicate that reception pattern La has been selected. Similarly, in FIG. 8*b*, LEDs 106, 108, and 110 are lit to indicate that the lobe, or reception pattern, L(a+b). In FIG. 8*c* all the LEDs are lit to indicate that the omnidirectional pattern L(a+b+c) has been selected. And, in FIG. 8*d*, LEDs 106 and 112 are lit to indicate that the L(a−0.5(b+c)) pattern has been selected. The LED lighting pattern will typically be updated at the same time the response pattern selection decision is made.

Figure 9:
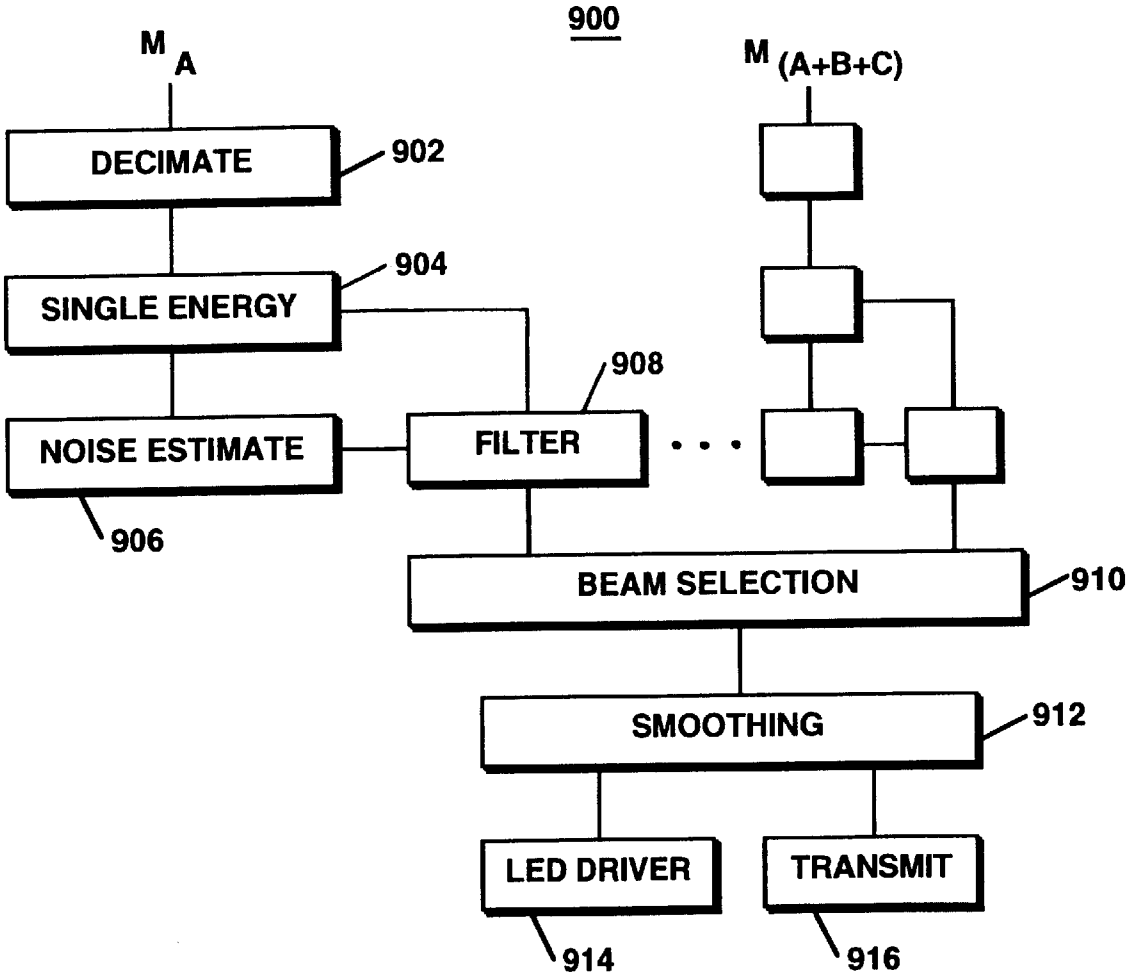
FIG. 9 is a functional block diagram showing the steps involved in beam selection and visual feedback for the microphone system.

Signal mixing, selection of reception patterns, control of the audio output signal and control of the visual indicators may be accomplished by an apparatus 900 which, in the illustrative embodiment, is implemented by a digital signal processor according to the functional block diagram of FIG. 9. Each microphone A, B, C, produces an electrical signal $M_A$, $M_B$, $M_C$, respectively, in response to an acoustic input signal. The analog response signals, $M_A$, $M_B$, and $M_C$ for each microphone are sampled at 8,000 samples per second. Digitized signals from each of the three microphones A,B, and C are combined with one another to produce a total of thirteen microphone signals $M_A$, $M_B$, $M_C$, $M_{(A+B)}$, etc., which provide maximum signal response for each of six radial directions spaced 60° apart and other combinations as discussed above. Response signals $M_{(A+B)}$, $M_{(A+C)}$, $M_{(B+C)}$, etc., are formed by weighting, adding and subtracting the individual sampled response signals, thereby producing a total of thirteen response signals as previously described. For example, $wM_A+(1-w)M_B=M_{(A+B)}$, where w is a weighing factor less than one, chosen to produce a response corresponding to a microphone situated between microphones A and B.

Because each of the thirteen signals is operated upon in the following manner before being operated upon in the beam selection functional block 910, only the operation upon signal $M_A$, will be described in detail, the same process applies to all thirteen signals. The digital signals are decimated by four in the decimator 902 to reduce signal processing requirements. Signal energies $P_i(k)$ are continuously computed in functional block 904 for 16 ms signal blocks (32 samples) related to each of the thirteen response signals, by summing the absolute values of the thirty-two signal samples within each 16 ms block; i.e., totaling the thirty-two absolute values of signal samples within each block:

$$P_i(k)=\Sigma|m_{ij}(k)|$$

where:

i is an index ranging from 1 to 13, corresponding to the thirteen response signals and $1 \geqq j \geqq 32$ $P_i(k)$ is the signal energy associated with the ith response signal $|m_{ij}(k)|$ is the absolute value of the jth sample of the ith signal The signal energies thus-computed are continuously low-pass filtered by adding a weighted filtered energy value from the previous block to a weighted energy value from the current block:

$$F_i(k)=aP_i(k)+(1-a)F_i(k-1)$$

Where:

$F_i$ is the ith microphone's filtered energy value for the kth sample block $P_i$ is the ith microphone's signal energy value for the kth sample block i is an index which varies from 1 to 13

$0<a<1$, typically a=0.9

The minimum of all block energy values computed for a given microphone over the previous 1.6 seconds (100 sample blocks) is used in functional block 906 as a noise estimate for the associated microphone, or virtual microphone, i.e., $N_i(k)$=min $\{P_i(k)$ over 1.6 seconds$\}$The current filtered energy values $F_i(k)$ are summed to yield a total filtered energy value $F_T(k)$.

$$F_T(k)=\Sigma F_i(k)$$

Similarly, the respective noise values, $N_i(k)$, are summed to yield a total noise energy value.

The microphone signal associated with the highest current filtered energy value $F_i(k)$ is selected in functional block 910 as a candidate for the microphone array's output signal. Smoothing is performed in functional block 912 as follows. If the total filtered energy value $F_T(k)$ is greater than 1.414 times the previous total filtered energy value, and is greater than twice the total noise energy value, the selected output signal is used as the array output signal. Otherwise, the current signal from the previously-used microphone is used as the array output signal. This smoothing process significantly reduces whatever residual dithering may remain in the beam selection process. That is, although the broader beam patterns afforded by combinations such as the A+B, A+C, etc. combinations reduce dithering, when compared to conventional systems, the smoothing process provides additional margin, particularly when selecting among narrower beam patterns. The thus-selected output array signal is coupled for transmission on telephone lines in functional block 916. The selected signal is also employed, in functional block 914, to control the visual indicators, as previously described.

Figure 10:
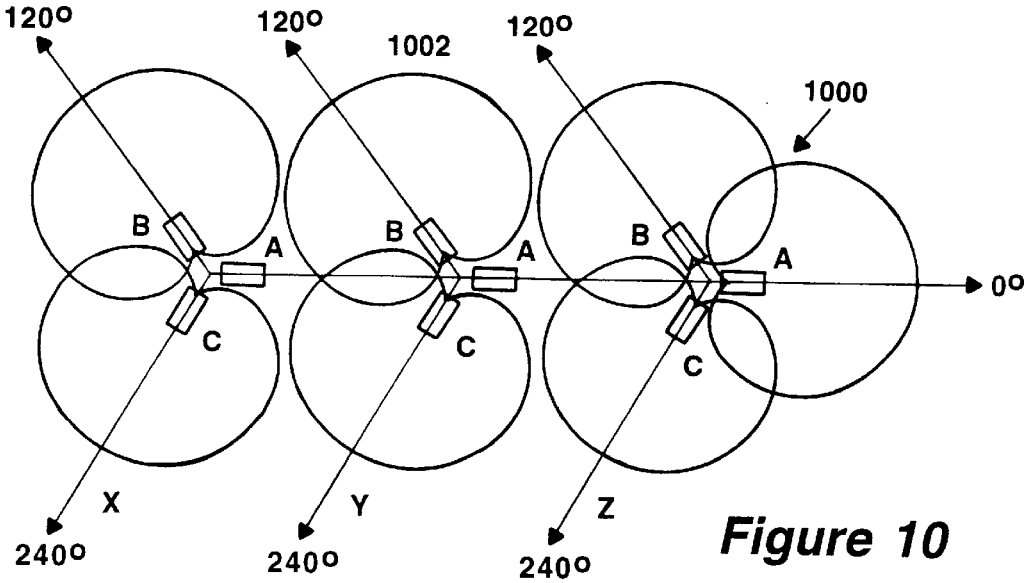
FIG. 10 is a conceptual block diagram of cascaded microphone arrays in accordance with the principles of the present invention.
Figure 7:
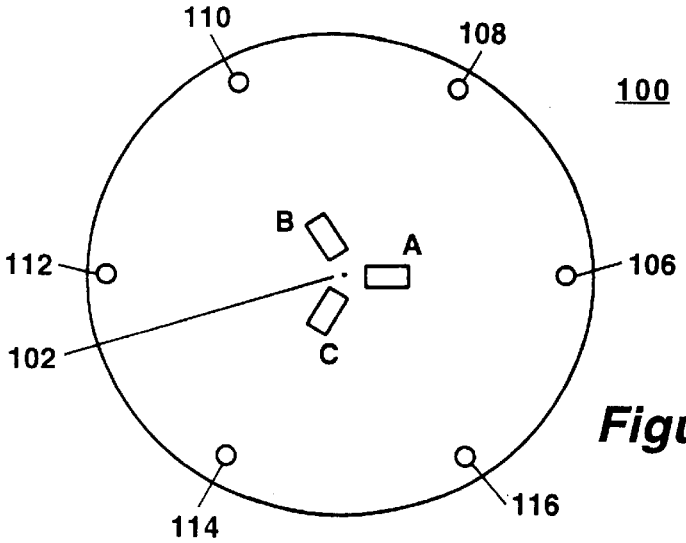
FIG. 7 is a top plan view of a LED microphone layout and LED pattern in accordance with the principles of the invention.

A plurality of the microphone arrays just described may be cascaded, as illustrated in FIG. 10. In such as cascaded arrangement, the output audio signal from one microphone system 1000 is input into a second similar system 1002. The second system 1002 uses its two directional microphones in addition to the first system's output to produce its composite output signal. Thus, the third microphone signal in the second unit is being replaced by the composite signal of the first unit. Similarly, a third microphone systems 1004 may be linked to the others. Such a cascading of microphone systems may employ two or more microphone systems. Alternatively, the microphone units may act independently, with an external controller determining the amount of mixing and switching among the systems' outputs. The composite outputs from each system would be fed into this controller.

The forgoing description of specific embodiments of the invention has been presented for the purposes of illustration and description. It is not intended to be exhaustive or to limit the invention to the precise forms disclosed, and many modifications and variations are possible in the light of the above teachings. The embodiments were chosen and described in order to best explain the principles of the invention and its practical application and to thereby enable others skilled in the art to best utilize the invention. It is intended that the scope of the invention be limited only by the claims appended hereto.

What is claimed is:

1. A microphone system for use in an environment where an acoustic source emits energy from diverse and varying locations within the environment, comprising:

at least two directional cardioid microphones held in a fixed arrangement about a center point, the respective response of each of the microphones being directed radially away from the center point, the microphones producing electrical signals in response to acoustic signals, mixing circuitry for combining electrical signals from the microphones to form a set of composite electrical signals, each composite electrical signal corresponding to a predetermined acoustic reception pattern wherein at least some of the predetermined acoustic reception patterns corresponding to the set of composite electrical signals have different spatial shapes and sizes, and control circuitry for analyzing the signal energy value of each composite electrical signal in the set to thereby determine an acoustic reception pattern which best fits the angular orientation and physical pattern of the acoustic source relative to the central point and to select the corresponding composite electrical signal for transmission.

2. The microphone system of claim 1 wherein the control circuit substantially continuously analyzes the composite electrical signals and selects for transmission the composite electrical signal corresponding to the acoustic reception pattern having the highest energy value.

3. The microphone system of claim 2 wherein the control system determines the best fit substantially as the composite electrical signal related to the acoustic response pattern having the highest average filtered energy value over a given time period.

4. The microphone system of claim 3 wherein the control system alters the selection of the composite electrical signal to be transmitted only if the most recent best fit value exceeds the prior best fit value by a predetermined amount.

5. The microphone system of claim 4 wherein the control system selects a composite electrical signal corresponding to a combination of microphones having a relatively broad acoustic response pattern that substantially encompasses acoustic response patterns that the control system has recently been switching between.

6. The microphone system of claim 1 wherein the microphone array is a substantially coplanar array of microphones.

7. The microphone system of claim 1 wherein the microphone array comprises three cardioid microphones space 120 degrees apart.

8. The microphone system of claim 7 wherein the acoustic response patterns include a combination formed by adding the acoustic response patterns of two of the microphones.

9. The microphone system of claim 8 wherein the acoustic response patterns include a combination formed by adding the acoustic response patterns of all three microphones.

10. The microphone system of claim 1 further comprising:

a visual indication system controlled by the control system such that the control system produces a visual signal indicative of which acoustic response pattern has been chosen.

11. The microphone system of claim 10 wherein the visual indication system comprises a ring of LEDs concentric with the microphones.

12. In a microphone system for use in an environment where an acoustic source moves about the environment, a method comprising the steps of:

(a) providing at least two directional cardioid microphones held iii a fixed arrangement about a center point, the respective response of each of the microphones being directed radially away from the center point, the microphones producing electrical signals in responses to acoustic signals, (b) producing a sequence of samples for each microphone corresponding to the electrical signals, (c) combining sequences of samples from at least two microphones, thereby producing a set of composite sequences of samples, each sequence corresponding to a predetermined acoustic reception pattern, wherein at least some of the predetermined acoustic reception patterns corresponding to the set of composite sequences have different spatial shapes and sizes, (d) partitioning the composite sequences into subsequences of at least one sample each, (e) computing an energy value for each subsequence, (f) comparing the energy values for all subsequences partitioned from all composite sequences in the set, thereby determining the subsequence corresponding to an acoustic reception pattern which best fits the angular orientation and physical pattern of the acoustic source relative to the central point, and (g) selecting an electrical signal corresponding to a composite sequence from which the determined subsequence is partitioned for transmission.

13. The method of claim 12 wherein step (f) comprises the step of:

(f1) substantially continuously [analyzing the electrical signals] comparing the energy values for each subsequence.

14. The method of claim 13 wherein step (f) comprises the step of:

(f2) selecting for transmission the electrical signal corresponding to the acoustic reception pattern having the highest energy value.

15. The method of claim 13 wherein step (f) comprises the step of:

(f3) selecting for transmission the electrical signal corresponding to the acoustic reception pattern having the highest average filtered energy value over a given time period.

16. The method of claim 15 wherein step (f3) comprises the step of (f3a) altering the selection of the electrical signal to be transmitted only if the most recent best fit value exceeds the prior best fit value by a predetermined amount.

17. The method of claim 16 wherein step (f3) comprises the step of:

(f3b) selecting an electrical signal corresponding to a combination of microphones having a relatively broad acoustic response pattern that substantially encompasses acoustic response patterns that the control system has recently been switching between.

18. The method of claim 12 wherein step (a) comprises the step of:

(a1) providing at least three directional cardioid microphones held in a fixed arrangement about a center point spaced apart at equal angles, the respective acoustic response of each of the microphones being directed radially away from the center point.

19. The method of claim 12 further comprising the step of:

(h) producing a visual signal indicative of which acoustic response pattern has been chosen.

* * * * *

UNITED STATES PATENT AND TRADEMARK OFFICE

CERTIFICATE OF CORRECTION

PATENT NO. : 6,173,059 B1 
DATED : January 9, 2001
INVENTOR(S) : Jixiong Huang and Richard S. Grinnell It is certified that error appears in the above-identified patent and that said Letters Patent is hereby corrected as shown below:

Title page,
Item [54], in paragraph, Title: replace "TELECONFERENCING SYSTEM WITH VISUAL FEEDBACK" with -- TELECONFERENCING SYSTEM WHICH SELECTS AN OPTIMAL ACOUSTIC RECEPTION PATTERN FROM MULTIPLE PATTERNS HAVING DIFFERENT SHAPES AND SIZES --;

Column 10,
Line 26, replace "iii" with -- in --; and
Line 54, delete "analyzing the electrical signals".

Signed and Sealed this

Seventeenth Day of August, 2004

JON W. DUDAS
*Acting Director of the United States Patent and Trademark Office*